US006754976B1

(12) United States Patent
Edwards

(10) Patent No.: US 6,754,976 B1
(45) Date of Patent: Jun. 29, 2004

(54) IN-WALL DRYER VENT FOR VENTING TO ANOTHER FLOOR

(76) Inventor: David G. Edwards, 518 Lakeview Dr., Paducah, KY (US) 42003

( * ) Notice: Subject to any disclaimer, the term of this patent is extended or adjusted under 35 U.S.C. 154(b) by 0 days.

(21) Appl. No.: 10/618,306

(22) Filed: Jul. 14, 2003

(51) Int. Cl.[7] ..... F26B 11/02

(52) U.S. Cl. ..... 34/140; 34/235; 285/425; 285/907

(58) Field of Search ..... 34/235, 85, 86, 34/140; 285/405, 425, 907

(56) References Cited

U.S. PATENT DOCUMENTS

| | | | | | |
|---|---|---|---|---|---|
| 2,290,333 | A | * | 7/1942 | Johnson | 285/55 |
| 3,892,049 | A | * | 7/1975 | Adams, Jr. | 34/235 |
| 4,834,149 | A | * | 5/1989 | Fournier et al. | 141/1 |
| 4,890,396 | A | | 1/1990 | King | |
| 5,359,820 | A | | 11/1994 | McKay | |
| 5,476,183 | A | | 12/1995 | Harpenau | |
| 5,590,477 | A | | 1/1997 | Carfagno, Sr. | |
| 5,915,735 | A | * | 6/1999 | Noble | 285/4 |
| 6,230,418 | B1 | * | 5/2001 | Gomulinski | 34/140 |
| 6,419,102 | B1 | | 7/2002 | Harpenau | |
| 6,550,157 | B1 | * | 4/2003 | Harding | 34/140 |

* cited by examiner

*Primary Examiner*—Ira S. Lazarus
*Assistant Examiner*—Kathryn S. O'Malley
(74) *Attorney, Agent, or Firm*—Richard C. Litman

(57) ABSTRACT

The in-wall dryer vent for venting to another floor is used to vent clothes dryer exhaust to a floor other than that on which the clothes dryer is located. The invention has an upper portion adapted for installation within the three and one-half inch cavity inside a wall constructed with standard two-by-four studs, and has a lower portion that expands to a width of at least four inches from front to back. The upper portion has a flanged opening adapted to extend through drywall and attach to standard clothes dryer outlet coupling devices. The lower portion has an outlet tube adapted for coupling to standard dryer vent piping.

12 Claims, 8 Drawing Sheets

IN-WALL DRYER VENT FOR VENTING TO ANOTHER FLOOR

BACKGROUND OF THE INVENTION

1. Field of the Invention

The present invention relates to clothes dryer exhaust vents, and more particularly, to a vent that is installed in a wall constructed with standard sized studs prior to the installation of drywall for later use in venting dryer exhaust.

2. Description of the Related Art

Generally, clothes dryer exhaust is vented out of a house through an exterior wall. When the dryer is positioned against an exterior wall, the outlet of the dryer is typically attached to a cylindrical vent that simply passes through the exterior wall. However, in situations where the dryer cannot be positioned against an exterior wall, the dryer exhaust is often vented through the main floor into the basement or crawl space below the house and then through an exterior wall. Unfortunately though, venting dryer exhaust through a basement or crawl space presents a well-known problem.

Standard dryer vent piping is four inches in diameter but the cavity in a wall constructed with standard two-by-four studs is only three and one-half inches deep. Consequently, standard dryer vent piping cannot be installed inside a standard wall and thus cannot be used in most homes to vent dryer exhaust from a first floor dryer to the basement via a wall. As a result, venting dryer exhaust to a basement requires either the installation of non-standard sized vent pipe inside the wall or the use of exposed standard sized vent pipe. However, neither of these alternatives is desirable. The use of non-standard sized vent pipe can result in airflow resistance, since such pipe typically has a smaller diameter than that of a dryer exhaust outlet, which is conventionally four inches. On the other hand, the use of exposed standard sized dryer vent pipe is unsightly.

The prior art includes two devices for venting a first floor dryer to the basement. U.S. Pat. No. 5,590,477, issued Jan. 7, 1997 to M. B. Carfagno, Sr., teaches a dryer vent box consisting of two interconnecting rectangular boxes that are connected to form one elongated rectangular vent. The elongated rectangular vent fits inside a wall constructed with two-by-four studs and has two cylindrical openings—one opening for receiving dryer exhaust and one for expelling the exhaust into dryer vent piping. However, this device has at least three drawbacks. First, the device consists of two components that must be assembled prior to installation. Assembly of these components can be time consuming, and also presents the risk of an air leak if not properly assembled. Second, due to the configuration of the two rectangular boxes, the lower cylindrical opening can only be oriented in one of two possible horizontal positions and, thereby, limits options when connecting to dryer vent piping in the basement. Third, the device is particularly susceptible to lint accumulation in the portion of the elongated rectangular vent below the bottom of the lower cylindrical opening.

U.S. Pat. No. 4,890,396, issued Jan. 2, 1990 to T. P. King teaches an adjustable dryer vent connection consisting of a box-shaped housing that fits between standard two-by-four studs. One face of the housing has a cylindrical opening and four accordion panels that work together to change the location of the opening on the face. The bottom of the housing rests on the two-by-four floor plate and has an opening that is connected to exhaust vent piping passing through the floor plate. Because the device is configured with its bottom opening positioned above the floor plate and within the wall, the bottom opening cannot be more than three and one-half inches in diameter and therefore cannot be connected directly to standard four inch dryer exhaust vent piping. As a result, the device's three and one-half inch exhaust opening can cause airflow resistance.

Other patents showing devices for venting dryer exhaust into a wall include U.S. Pat. No. 3,892,049, issued Jul. 1, 1975 to P. Adams, Jr. (clothes dryer vent attachment for a mobile home); U.S. Pat. No. 5,359,820, issued Nov. 1, 1994 to M. R. McKay (wall insert providing a recessed area in a wall to accommodate washer and dryer fittings); U.S. Pat. Nos. 5,476,183 and 6,419,102, issued Dec. 19, 1995 and Jul. 16, 2002, respectively, to R. J. Harpenau (recessed wall boxes for attaching clothes dryer exhaust vent piping thereto); and U.S. Pat. No. 6,230,418, issued May 15, 2001 to D. R. Gomulinski (low profile dryer exhaust vent).

Consequently, none of the above inventions and patents, taken either singly or in combination, is seen to describe the instant invention as claimed and therefore an in-wall dryer vent for venting to another floor solving the aforementioned problems is desired.

SUMMARY OF THE INVENTION

The in-wall dryer vent for venting to another floor is used to vent clothes dryer exhaust to a floor other than that on which the clothes dryer is located. The invention has an upper portion adapted for installation within the three and one-half inch cavity inside a wall constructed with standard two-by-four studs, and has a lower portion that expands to a width of at least four inches from front to back. The upper portion has a flanged opening adapted to extend through drywall and attach to standard clothes dryer outlet coupling devices. The lower portion has an outlet tube adapted for coupling to standard dryer vent piping.

Accordingly it is a primary object of the invention to provide a device that enables venting of dryer exhaust to a floor other than that on which the dryer is located via a wall constructed with standard two-by-four studs.

It is another object of the invention to provide a device for venting dryer exhaust to another floor that has a flanged outlet oriented on a vertical axis and adapted for direct attachment with standard dryer venting piping.

It is a further object of the invention to provide a device for venting dryer exhaust to another floor that fits between standard size studs within a wall and thereby saves space and is easy and inexpensive to install.

Still another object of the invention is to provide a device for venting dryer exhaust to another floor that is clean, simple and attractive in appearance.

It is a further object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 4:
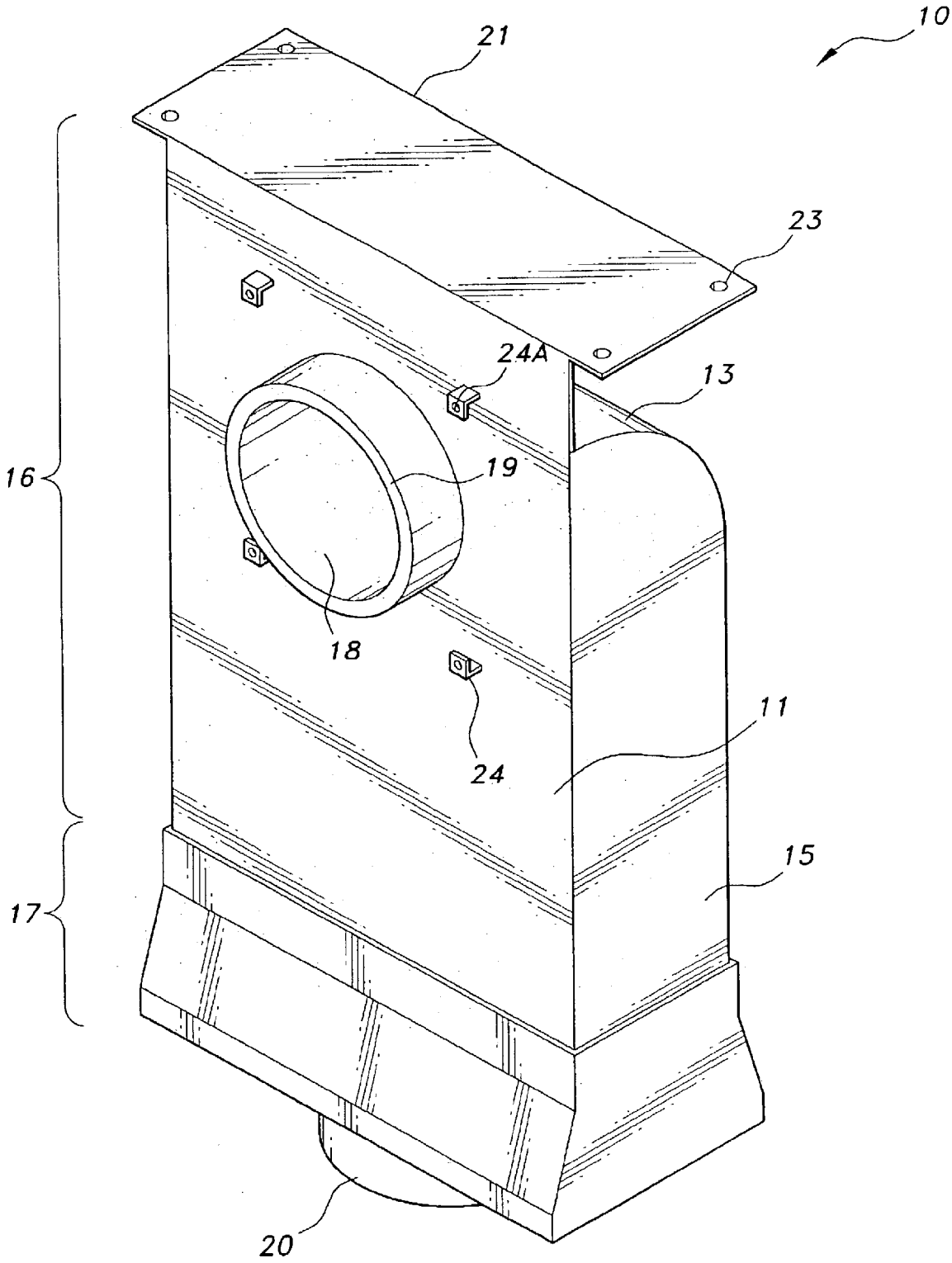
FIG. 4 is an perspective view of an in-wall dryer vent for venting to another floor according to the present invention.
Figure 5:
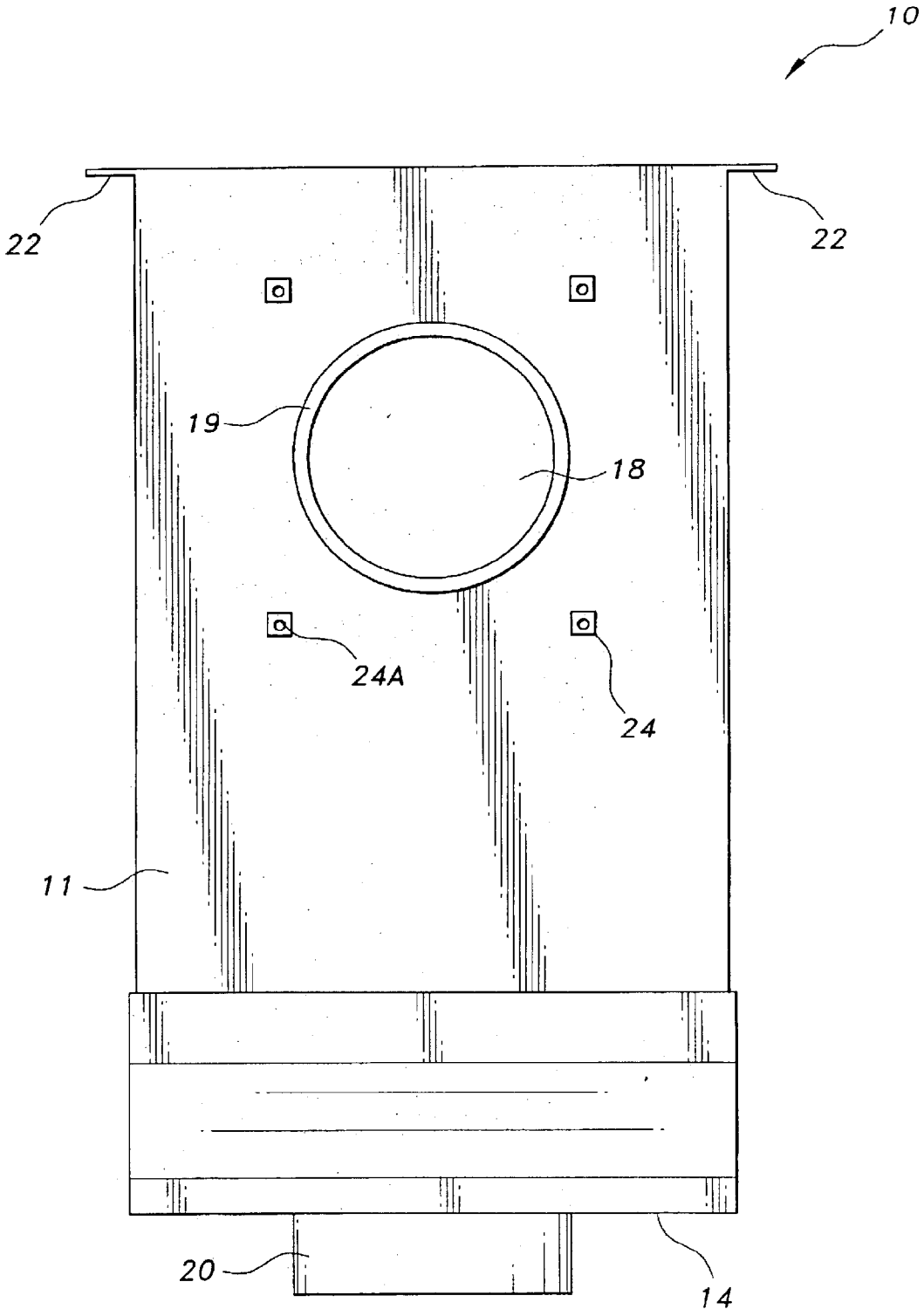
FIG. 5 is an elevational front view of an in-wall dryer vent for venting to another floor according to the present invention.
Figure 6:
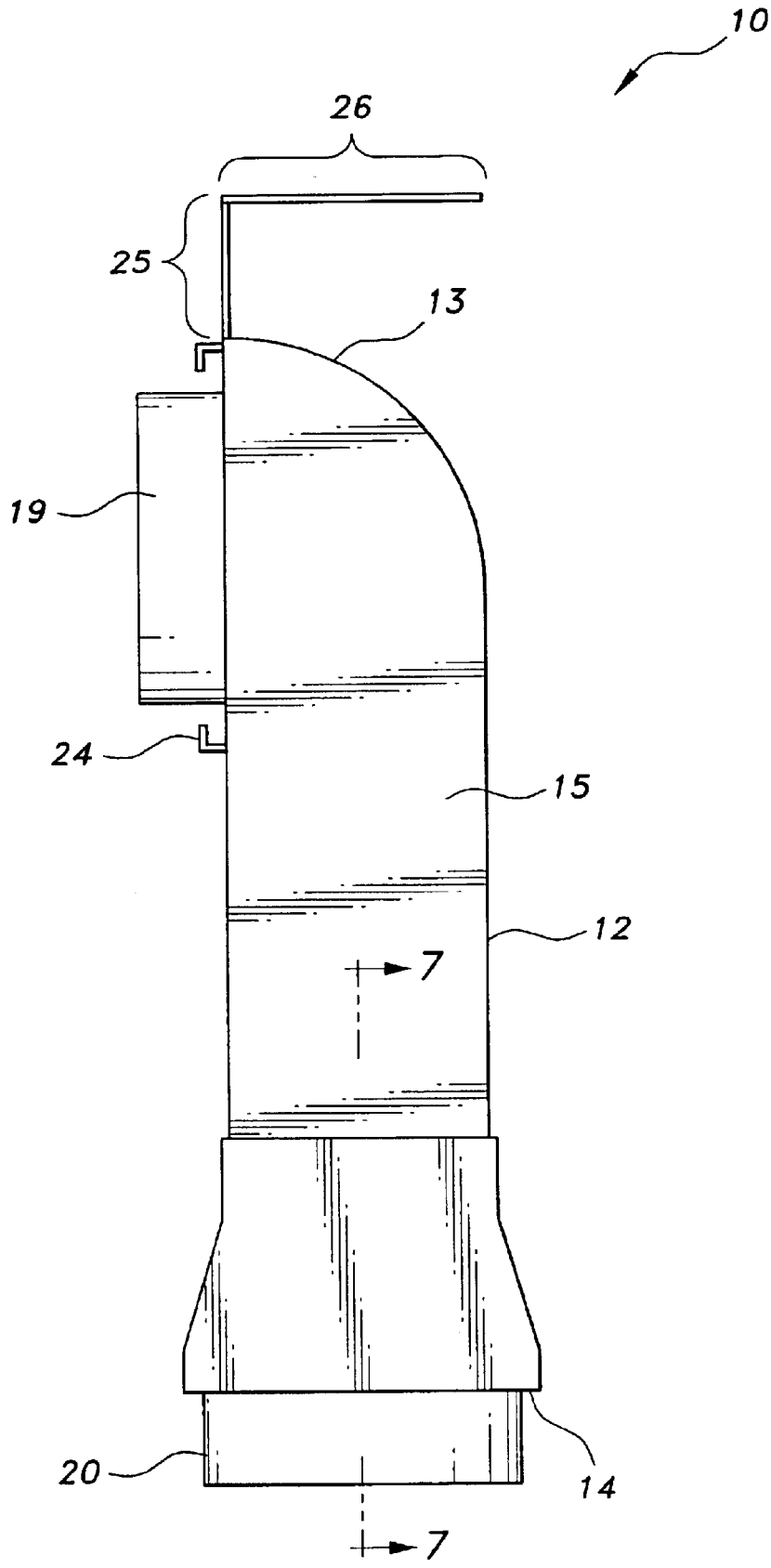
FIG. 6 is an elevational side view of an in-wall dryer vent for venting to another floor according to the present invention.

The present invention is an in-wall dryer vent for venting to another floor, designated generally as 10 in the drawings. Referring first to FIGS. 4–6, the invention is a tubular body having an upper portion 16 including a planar front wall 11, an arcuate back wall 12, a top end 13, a bottom end 14 and two planar side walls 15. The back wall 12 is substantially parallel to the front wall 11 at the bottom and middle of the upper portion 16, defining a rectangular duct or conduit, but curves forward to join the top edge of the front wall 11 at the top end 13 of the upper portion 16. The vent includes a lower portion 17. The upper and lower portions 16 and 17 of the vent 10 are contiguous and form a single chamber for venting dryer exhaust. The upper portion 16 is shaped and dimensioned to fit between standard size studs S within a wall. Thus, the depth of the vent 10 from front 11 to back 12 is less than three and one-half inches and the width between the side walls 15 is less than sixteen inches. The upper portion 16 has a flanged opening 18 positioned on the front 11, with the annular flange 19 extending outward from the device 10. To facilitate attachment to standard dryer outlet coupling devices, the annular flange 19 has a diameter of four inches.

The lower portion 17 of the vent 10 has a rectangular inlet connected to the upper portion 16 and a round outlet. The lower portion 17 has a substantially uniform width between the side walls 15, but increases in depth from front to back from less than three and one-half inches at it juncture with the upper portion 16 to at least four inches at the outlet.

The outlet of the lower portion 17 has a cylindrical outlet tube 20 extending therefrom. The outlet tube 20 extends downward and has a diameter of four inches to facilitate attachment to standard dryer exhaust vent piping. A section of standard dryer exhaust piping P with a ninety-degree bend can be attached to the outlet tube 20 in a manner permitting the piping P to be easily oriented in any desired direction.

An L-shaped main support flange 21 is attached to the upper portion 16 of the device 10. As shown in FIG. 6, the main support flange 21 is L-shaped, having a first rectangular wall 25 that extends upward from the top front of the vent 10 and joins the front edge of a second rectangular wall 26 normal to the first wall and extending toward the back of the vent 10. The second wall 26 is wider than the spacing between side walls 15 and extends beyond the plane of each side wall 15. Each of the two portions 22 of the second wall 26 extending beyond the side walls 15 has two apertures 23 which are used to mount the vent 10 to a two-by-four cross beam C installed between the studs S, as shown in FIGS. 1 and 2.

Four smaller L-shaped flanges, 24 are also attached to the upper portion 16 of the vent 10, as seen in FIGS. 4 and 5. The smaller flanges 24 extend outward from the front wall 11 of the vent 10 and are positioned near the annular flange 19. Each of the smaller flanges 24 has a single aperature 24A used to secure the vent 10 to the drywall D through which the annular flange 19 passes and thereby provide added stability to the annular flange 19, as shown in FIG. 2.

The vent 10 can be manufactured from pressed metal with the upper and lower portions 16 and 17 formed separately and then welded together; or can be manufactured via plastic injection molding.

Figure 1:
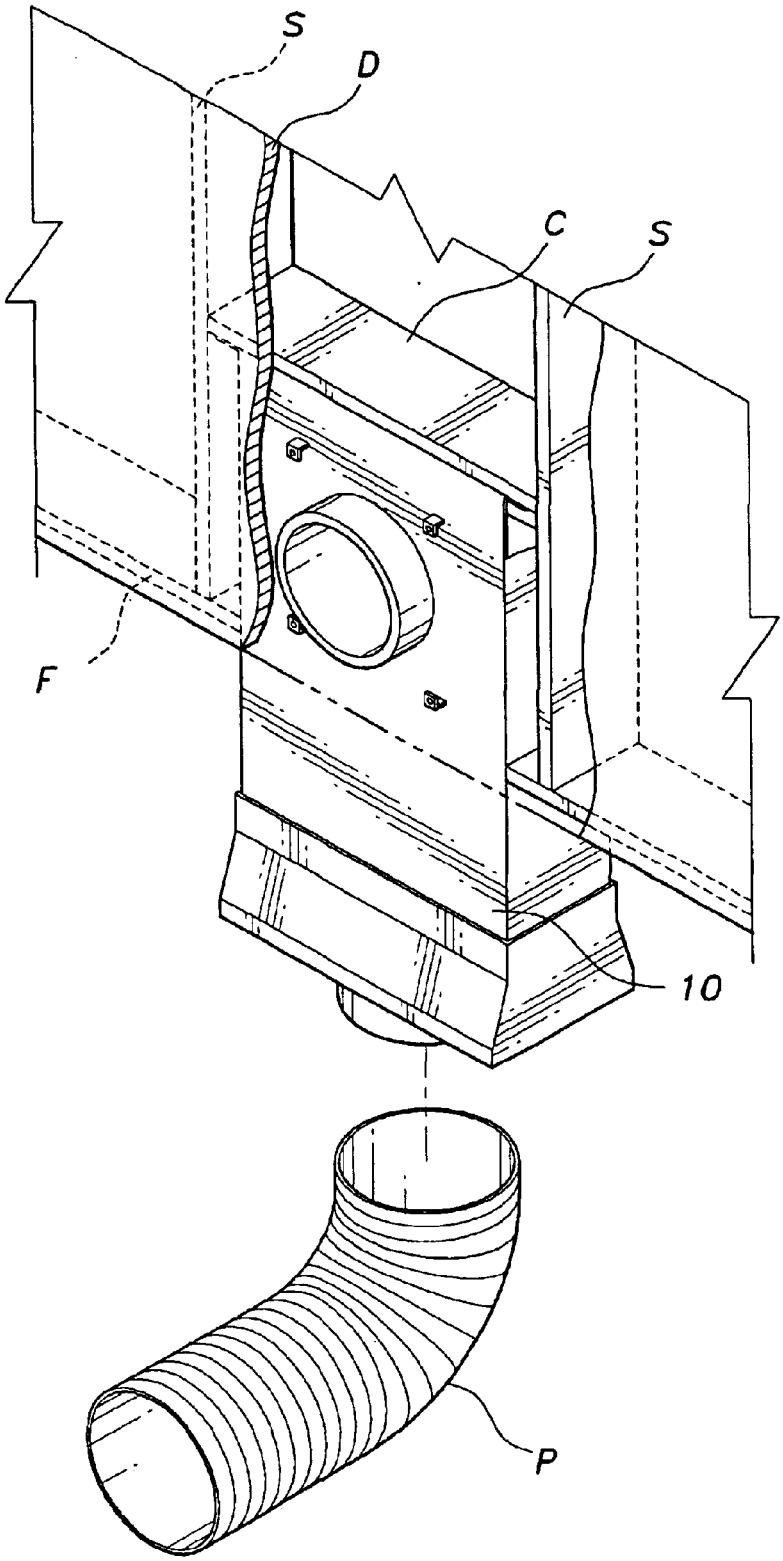
FIG. 1 is an environmental, perspective view of an in-wall dryer vent for venting to another floor according to the present invention as used in an interior house wall with wall components broken away.
Figure 2:
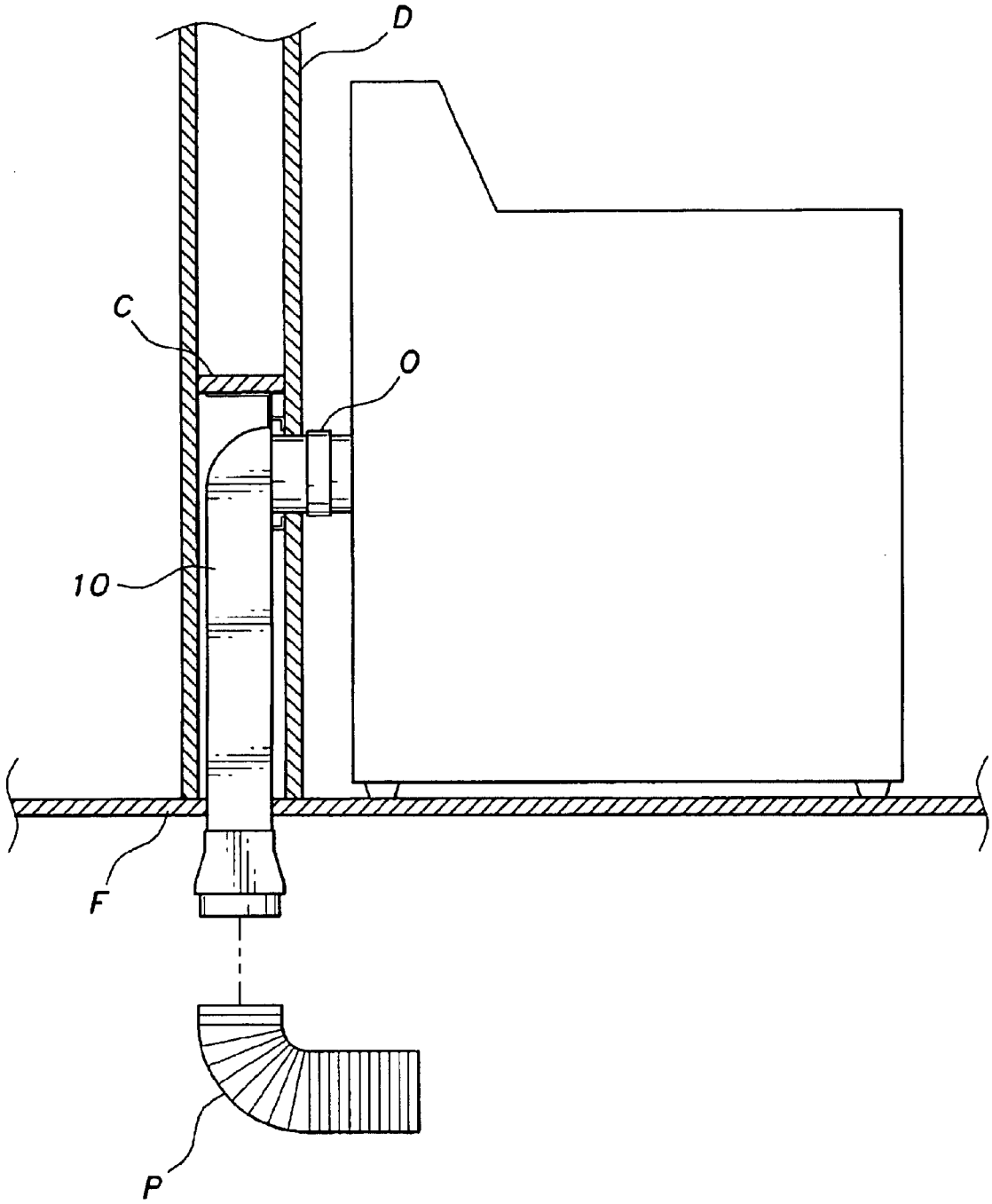
FIG. 2 is an environmental, side view of an in-wall dryer vent for venting to another floor according to the present invention as used to vent a dryer to a lower floor with house wall and floor shown in cross section.

As shown in FIGS. 1 and 2, the vent 10 is installed inside a wall with the annular flange 19 on the front 11 extending through the drywall D and attaching to the dryer exhaust outlet 0. The main support flange 21 is attached to a cross beam C. The upper portion 16 of the vent 10 extends downward within the wall and through the floor plate F. The lower portion 17 of the vent 10, which is entirely below the floor F, flares to a width wider than that of the cavity in the wall. The outlet tube 20 on the bottom of the vent 10 is attachable to standard dryer exhaust vent piping P.

Figure 3:
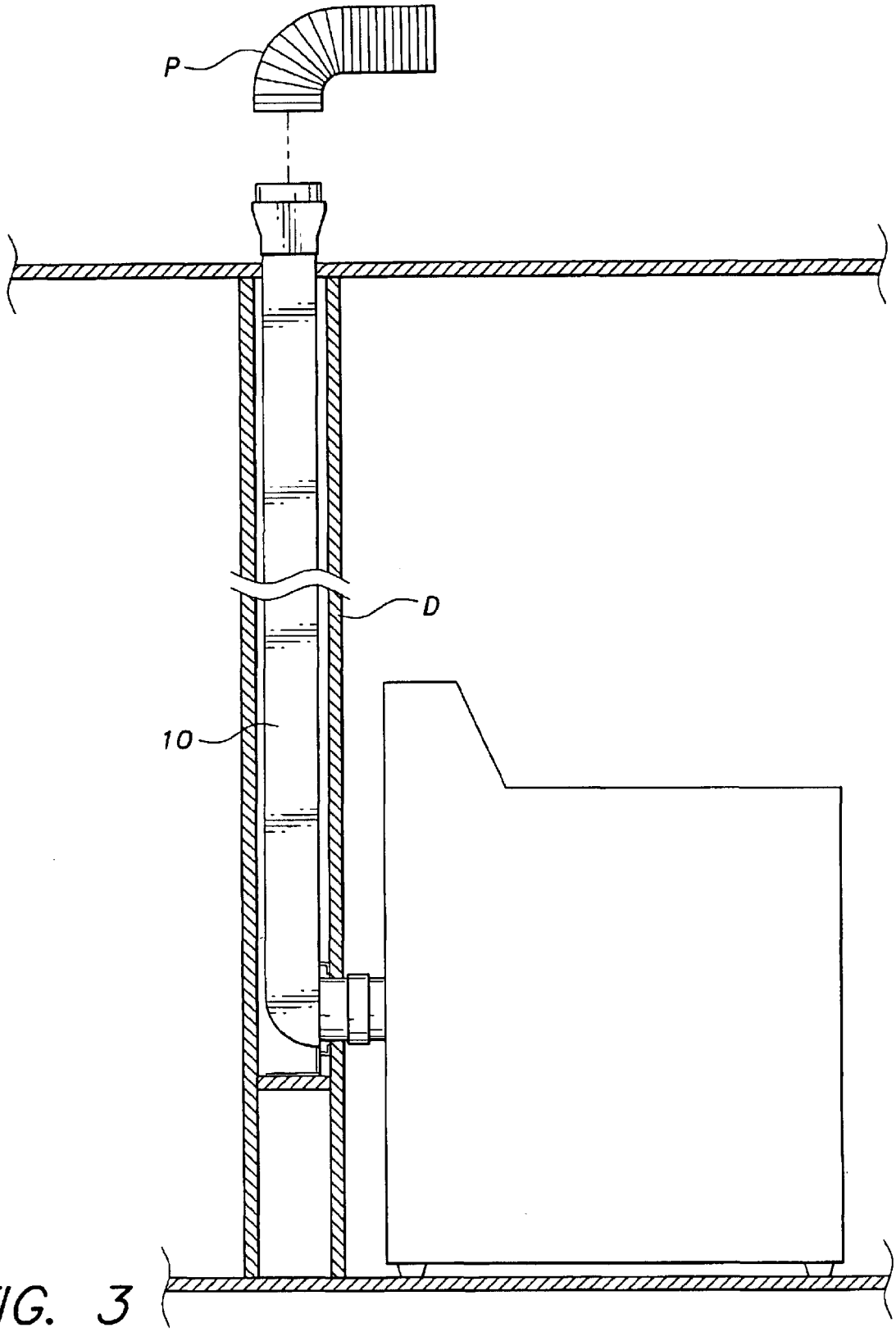
FIG. 3 is an environmental, side view of an in-wall dryer vent for venting to another floor according to the present invention as used to vent a dryer to an upper floor with the house wall, ceiling and floor shown in cross section.

The vent 10 can also be installed in an inverted position, as shown in FIG. 3, to vent to an attic or upper floor. In such a circumstance, the body of the vent 10 may be longer from top 13 to bottom 14 than when used to vent to a basement or crawl space.

Figure 7:
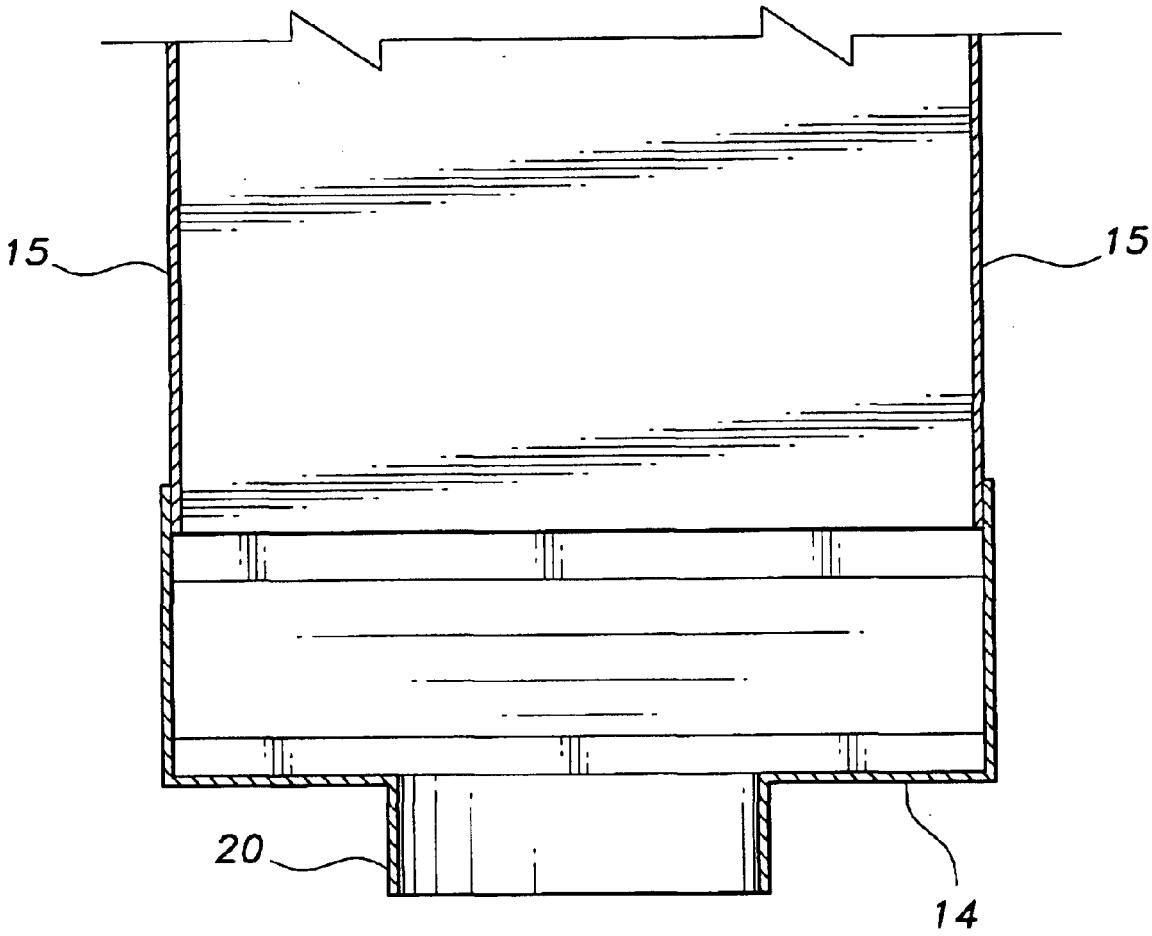
FIG. 7, is a fragmented cross-sectional view of an in-wall dryer vent for venting to another floor according to the present invention drawn along line 7—7 of FIG. 6.
Figure 8:
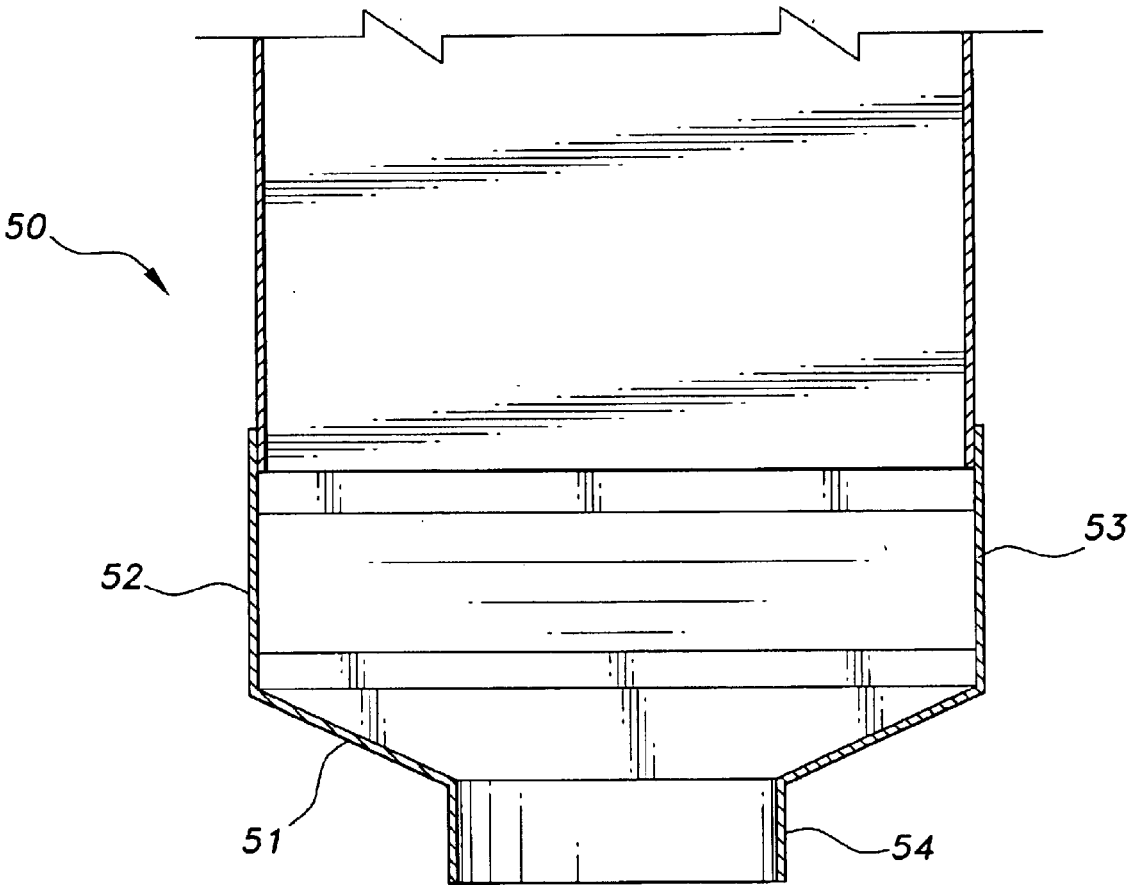
FIG. 8 is a fragmented cross-sectional view of an alternative embodiment of an in-wall dryer vent for venting to another floor according to the present invention.

In a fragmented cross-sectional view of the vent 10, as shown in FIG. 7, the bottom 14 is horizontal from side 15 to side 15 with the outlet 20 centrally disposed on the bottom 14. In an alternative embodiment 50, as shown in the fragmented cross-sectional view of FIG. 8, the bottom 51 is sloped downward from the two sides 52 and 53 toward the centrally disposed outlet 54.

It is to be understood that the present invention is not limited to the embodiment described above, but encompasses any and all embodiments within the scope of the following claims.

I claim:

1. An in-wall dryer vent for venting to another floor, comprising:

tubular body having:

an upper portion and a lower portion;

said upper portion including a planar front wall having a circular opening defined therein, at least two planar side walls, a rear wall having an arcuate top end, and a bottom end, the arcuate top end defining a curved surface extending from the front wall toward the bottom end of the rear wall, and extending between the side walls, wherein the front wall, rear wall and side walls define a rectangular conduit having a rectangular open bottom thereof, and a closed curved top, an annular flange projecting from the circular opening defined in the front wall of the upper portion, the annular flange being adapted for attachment to a clothes dryer outlet;

at least one L-shaped mounting flange having a first portion having a first end and a second end, the first end perpendicularly attached to, and extending outwardly from said front wall, the second end perpendicularly attached to a second portion, the second portion extending parallel to said front wall, said second portion of each said at least one L-shaped mounting flange having an aperture therein;

a said lower portion having a rectangular inlet joined to the rectangular open bottom of the upper portion and having a rectangular outlet end, the outlet end having a greater perimeter than the inlet;

an outlet tube extending from the outlet end of the lower portion;

wherein said upper portion has a width and depth dimension and configured for disposing the upper portion between adjacent studs of a wall, the lower portion being adapted for expanding cross-sectional area of the tubular body on a side of a floor partition opposite the upper portion.

2. The in-wall dryer vent according to claim 1, further comprising:

a mounting flange extending from the top end of said upper portion, the mounting flange being L-shaped and having a first wall extending from said upper portion and a second wall normal to the first wall and extending toward the back of the tubular body, the second wall being adapted for attachment to a cross beam extending between the adjacent studs.

3. The in-wall dryer vent according to claim 1, wherein said upper portion has a width of less than sixteen inches and a depth of less than three and one-half inches, whereby said upper portion is dimensioned and configured for being placed between two-by-four studs spaced sixteen inches on center.

4. The in-wall dryer vent according to claim 1, wherein said upper portion and said lower portion are constructed from metal.

5. The in-wall dryer vent according to claim 1, wherein said upper portion and said lower portion are constructed from plastic.

6. The in-wall dryer vent according to claim 1, wherein said lower portion has a width of less than sixteen inches, and has a depth of less than three and one-half inches at the inlet and at least four inches at the outlet end.

7. The in-wall dryer vent according to claim 1, wherein said annular flange has a diameter of about four inches.

8. The in-wall dryer vent according to claim 1, wherein said outlet tube has a diameter of about four inches, being adapted for attachment to dryer exhaust piping.

9. The in-wall dryer vent according to claim 1, wherein the lower portion as a bottom wall normal to said outlet tube.

10. The in-wall dryer vent according to claim 1, wherein the lower portion has a bottom wall sloping inward towards said outlet tube.

11. The in-wall dryer vent according to claim 1, wherein said at least one L-shaped mounting flange includes a plurality of mounting flanges spaced equidistantly around said annular flange of said front wall.

12. The in-wall dryer vent according to claim 11, wherein said plurality of L-shaped mounting flanges are four.

* * * * *